US009775764B1

(12) United States Patent
Rill

(10) Patent No.: US 9,775,764 B1
(45) Date of Patent: Oct. 3, 2017

(54) REAR CHAIN STRETCHER

(71) Applicant: Balthasar Rill, Battlement Mesa, CO (US)

(72) Inventor: Balthasar Rill, Battlement Mesa, CO (US)

(73) Assignee: BD MFG LLC, Parachute, CO (US)

( * ) Notice: Subject to any disclaimer, the term of this patent is extended or adjusted under 35 U.S.C. 154(b) by 0 days.

(21) Appl. No.: 15/092,196

(22) Filed: Apr. 6, 2016

(51) Int. Cl.
*A63B 21/00* (2006.01)
*A63B 21/04* (2006.01)
*A61H 1/02* (2006.01)

(52) U.S. Cl.
CPC ..... *A61H 1/0266* (2013.01); *A63B 21/00* (2013.01)

(58) Field of Classification Search
CPC ..... A63B 21/00185; A63B 21/002; A63B 21/0023; A63B 21/04; A63B 21/0442; A63B 21/05; A63B 21/0552; A63B 21/0555; A63B 21/0557; A63B 21/4015; A63B 21/4034; A63B 21/4035; A63B 21/4039; A63B 23/08; A63B 23/10; A63B 2023/006; A63B 2225/68; A63B 2225/682; A63B 2225/685; A63B 2225/687; A63B 21/0004; A63B 2208/0204; A63B 21/00043; A63B 2071/027
USPC ..... 482/131
See application file for complete search history.

(56) References Cited

U.S. PATENT DOCUMENTS 1,560,549 A * 11/1925 Duncan ..... A61H 15/00 601/118
2,160,722 A 10/1937 Cunnigham
2,340,666 A * 2/1944 Johanson ..... A47C 20/022 482/79
2,509,810 A * 5/1950 Core, Jr. ..... A63B 15/00 16/42 T
2,577,129 A * 12/1951 Johnston ..... A61H 15/00 492/30
3,006,646 A * 10/1961 Nanni ..... A63B 21/0624 482/109
3,119,614 A * 1/1964 Berry ..... A63B 21/0004 482/91
4,195,835 A * 4/1980 Hinds ..... A63B 21/0552 482/125
4,456,249 A 6/1984 Calabrese
4,606,539 A * 8/1986 Farnham ..... A63B 21/0023 482/148
4,693,470 A 9/1987 Ogawa
4,735,412 A * 4/1988 Prsala ..... A63B 21/055 482/125

(Continued)

*Primary Examiner* — Andrew S Lo
(74) *Attorney, Agent, or Firm* — Michael M. McGraw; Smith & Hopen, P.A.

(57) ABSTRACT

An exercise device for stretching the calf muscles and Achilles tendon of a user. The exercise device includes a rod with a pair of grips, a pair of straps, and a foot platform. The pair of straps has two ends; or a first end and a second end. The first end of each strap is affixed to opposing distal ends of the rod. The second end of the pair of straps is affixed to distal, or outside, ends of the foot platform. The exercise device can have a rotatable sleeve with a plurality of surface protuberances on the sleeve. The rotatable sleeve is mounted on the rod between the pair of grips. The rotatable sleeve can be used as a massager by rolling the sleeve over a muscle while gripping the grips on either side of the sleeve.

10 Claims, 5 Drawing Sheets

(56) References Cited

U.S. PATENT DOCUMENTS 5,122,107 A * 6/1992 Gardner ..... A63B 23/0211 482/140
5,125,649 A * 6/1992 Fuller ..... A63B 21/0004 482/106
5,312,314 A * 5/1994 Stephan ..... A63B 21/0602 482/106
5,372,566 A * 12/1994 Olschansky ..... A63B 23/0211 482/140
5,518,486 A 5/1996 Sheeler
5,549,532 A * 8/1996 Kropp ..... A63B 21/0552 482/122
5,611,770 A 3/1997 Tesch
5,674,163 A * 10/1997 Sennett ..... A63B 23/0216 482/125
5,820,531 A * 10/1998 Choi ..... A63B 21/072 482/110
5,853,354 A 12/1998 Kubota
6,110,078 A 8/2000 Dyer
6,203,476 B1 * 3/2001 Wang ..... A63B 21/0552 482/121
6,398,694 B1 * 6/2002 Bountourakis ..... B60K 28/16 123/486
6,450,930 B1 9/2002 Kroke
7,387,599 B1 * 6/2008 Hsu ..... A61H 15/0092 482/122
7,846,078 B1 * 12/2010 Park ..... A63B 21/0552 482/121
D688,337 S * 8/2013 Huang ..... D21/662
9,039,640 B2 * 5/2015 Crowell ..... A61H 15/0092 601/112
2002/0193210 A1 12/2002 Turner
2002/0198081 A1 * 12/2002 Chen ..... A63B 21/0004 482/23
2005/0239617 A1 * 10/2005 Tenaglia ..... A63B 21/00043 482/122
2006/0052223 A1 * 3/2006 Terry ..... A63B 21/0004 482/126
2007/0173387 A1 * 7/2007 Wu ..... A63B 21/0004 482/121
2008/0287272 A1 * 11/2008 Luckadue ..... A63B 21/027 482/107
2009/0192022 A1 * 7/2009 Kulka ..... A63B 21/153 482/46
2010/0234774 A1 * 9/2010 Cheremsky ..... A61H 1/005 601/23
2012/0040808 A1 2/2012 Khademi
2012/0135844 A1 * 5/2012 Huang ..... A63B 21/0004 482/108
2013/0345032 A1 * 12/2013 Aldridge ..... A61H 1/0237 482/131
2015/0343256 A1 * 12/2015 Coompol ..... A63B 21/0724 482/93
2016/0144217 A1 * 5/2016 Oltorik, Jr. ..... A63B 21/0442 482/130

* cited by examiner

REAR CHAIN STRETCHER

FIELD OF INVENTION

This invention relates generally to exercise and rehabilitation devices. More specifically, this invention relates to a lightweight, portable and easy-to-use device for stretching the muscles and tendons along the back of a user's leg.

BACKGROUND OF THE INVENTION

Stretching devices for therapy and injury prevention have become important tools for the injured and for athletes. Many of these devices target key muscles or muscle groups, such as the muscle groups of the back of the calf or the thigh. Some of these devices are quite complicated or bulky. For example, U.S. Pat. No. 4,693,470 to Ogawa teaches a stretching device having an angled standing surface that a user stands on to stretch their Achilles' tendons and calves. By varying the angle of the standing surface relative to the ground a user can adjust the degree of stretch created when standing on the device. However, adjusting the angle appears to require stepping off of the device, manipulating the device to achieve a new angle, and stepping back on the device. Accordingly, a user cannot easily increase the stretch during use as muscles and tendons become looser. In addition, the device is bulky, which reduces it portability.

U.S. Pat. No. 6,110,078 to Dyer teaches a passive stretching device for plantar fascia. The device has two hinged plates with a variable tensioning mechanism. A user secures their foot and lower leg to the device and the distal ends of the opposed plates are pulled together with a spring. As with the '470 device to Ogawa, this device is bulky and is not amenable to quick changes in the force applied to the stretching as the muscles become looser. U.S. Pat. No. 5,853,354 ("the '354 patent") to Kubota teaches a similar device. The device of the '354 patent includes a part that straps to the lower leg of a user and a footplate, with the two parts connected by a hinge. Force is applied by the user to pull the footplate towards the user resulting in dorsiflexion of the user's foot. Again, this is a bulky device and must be strapped to the user's foot and lower leg prior to use.

Other, more simple, devices exist to aid in stretching. For example, U.S. Patent Application Publication No. 2012/0040808 A1 ("Pub. No. '808") to Khademi describes a stretching and exercise device with a plurality of strap members, including strap members designed to hold a user's foot and a strap member designed to be grasped by a user. Pub. No. '808 describes the device as a "stretching and exercise device adapted for lower body muscle stretch, including the user's lower back and legs" or alternatively, "a stretching and exercise device adapted for isolating and exercising the foot/calf or hamstring/hip muscles of an individual in an efficient and effective manner." This device employs a complicated system of straps and a plate to stretch the lower calf muscles, and is only capable stretching a single leg at a time.

A number of devices employ multiple straps and/or handles to allow a user to stretch a single leg. For example, U.S. Pat. No. 4,456,249 ("the '249 patent") to Calabrese teaches a stretching apparatus with two ropes extending from a collar fitting over the head or neck of a user to a foot-receiving stirrup. The ropes have separate handgrips. A user puts one foot in the stirrup and pulls the handgrips to stretch various muscles and tendons while the device is anchored around the head or neck of a user. U.S. Pat. No. 5,518,486 ("the '486 patent") to Sheeler teaches an exercise device for a variety of exercises, including stretching. The device includes a foot loop, a hand grip, and an adjustable strap linking the foot loop to the harness. The device only allows for stretching a single leg at a time.

These devices tend to be complicated by the number of straps and/or they lack portability. In addition, the devices are designed solely for stretching and do not address other muscle issues, such as soreness, that can be resolved by massaging. The present invention overcomes these limitations and shortcomings of the prior art with the rear chain stretcher as described in detail below.

SUMMARY OF THE INVENTION

The long-standing but heretofore unfulfilled need for a portable, uncomplicated stretching device is now met by a new, useful, and nonobvious invention. The novel device further advances the art through the addition of embodiments including a massaging element integral to the device, thereby allowing a user to have a single device for stretching and working out soreness in muscles.

In a first aspect the present invention provides an exercise device for stretching the calf muscles and Achilles tendon(s) of a user. The exercise device includes a rod, or handle, with a pair of grips, a pair of straps, and a foot platform. The pair of straps have two ends; or a first end and a second end. The first end of each strap is affixed to opposing distal ends of the rod, or the portion of the rod towards either end of the rod. The second end of the pair of straps is affixed to distal, or outside, ends of the foot platform. In certain embodiments the length of the strap can be adjustable to tailor the device to the flexibility or height of the user. The foot platform is designed to be wide enough so that the balls of a user's feet can fit on the platform simultaneously. The grips on the rod are designed to be grasped by the hands of a user; in particular, gripping the grips and pulling the rod towards the abdomen or chest of the user will allow a user to create dorsiflexion of the user's feet.

The rod can be hollow and have a pair of end caps that removeably engage ends of the rod, such as by the threading of the end caps onto the rod. This can be used to secure the straps to the rod, such as when the straps have a loop at the end and the loop is just barely big enough to fit over the rod but not large enough to fit over the end caps. The interior space of the hollow rod can have one or two walls or dividers within the hollow space to create compartments thereby allowing storage of articles within the compartments of the rod by removing and replacing an end cap.

In addition, the strap width can be made narrower than the inner diameter of the rod and/or buckle. This allows the straps to be stored within the inner cavity of the rod when not in use.

In an advantageous embodiment the exercise device of the first aspect can include a rotatable sleeve with a plurality of surface protuberances on the sleeve. The rotatable sleeve is mounted on the rod between the pair of grips. The rotatable sleeve can then be used as a massager by rolling the sleeve over a user's muscle while gripping the grips on either side of the sleeve.

As discussed above, the strap length can be adjustable. Each strap can consist of two strap members linked by a buckle and the strap length can be adjusted by moving the buckle to a different position on one of the strap members.

In certain embodiments the rod is about 40 cm. to about 70 cm. long. For example, the rod can be about 40 cm., about 45 cm., about 50 cm., about 55 cm., about 60 cm., about 65 cm. or about 70 cm. in length. This approximates the width of a user's shoulders, allowing the user to more comfortably grasp the bar. In other words, the grips would be about shoulder width at their outer ends, with additional length on either end of the rod to accommodate the straps and endcaps. In an advantageous embodiment, the rod is about 55 cm. to about 65 cm. in length.

The foot platform can have a surface shape that conforms to the balls of a user's feet, such as a concave surface shape. The surface of the foot platform can also be textured or cushioned to help prevent slippage of the user's feet. The width, or length, of the foot platform will be roughly the same as the length of the rod.

In a second aspect the present invention provides a second exercise device. The exercise device of the second aspect, like the device of the first aspect, has a rod with a pair of grips, a pair of straps, and a foot platform. In the second aspect the rod is hollow and has a pair of end caps that removeably engage ends of the rod and secure the straps to the rod. The hollow rod can have one compartment, such as that between the interior of the rod and the two endcaps, or the rod can have a plurality of compartments, thereby allowing storage of articles within the rod by removing and replacing an end cap. The plurality of compartments can be created by having walls or dividers within the otherwise hollow handle. In an advantageous embodiment the strap width is narrower than the inner diameter of the rod. This allows the straps to be stored within the rod when not in use. In addition, the width of the buckles can also be narrower than the inner diameter of the handle to facilitate storage.

In a third aspect the present invention provides a third exercise device. The exercise device of the third aspect, like the device of the first aspect, has a rod with a pair of grips, a pair of straps, and a foot platform. In the third aspect the exercise device has a rotatable sleeve with a plurality of surface protuberances. The rotatable sleeve is rotatably coupled to the rod between the pair of grips. In other words, it is on the external surface of the rod in between the grips and is capable of rotation when the grips are held by a user and the sleeve is moved along the user's body. The surface protuberances can be various shapes, such as knobs. It is found that such protuberances enhance the massage effect.

BRIEF DESCRIPTION OF THE DRAWINGS

For a fuller understanding of the invention, reference should be made to the following detailed description, taken in connection with the accompanying drawings, in which:

FIG. 6A shows the end cap removed from the handle of the rear chain stretcher.

FIG. 6B shows the end cap removed from the handle of the rear chain stretcher.

DETAILED DESCRIPTION OF THE PREFERRED EMBODIMENT

Figure 1:
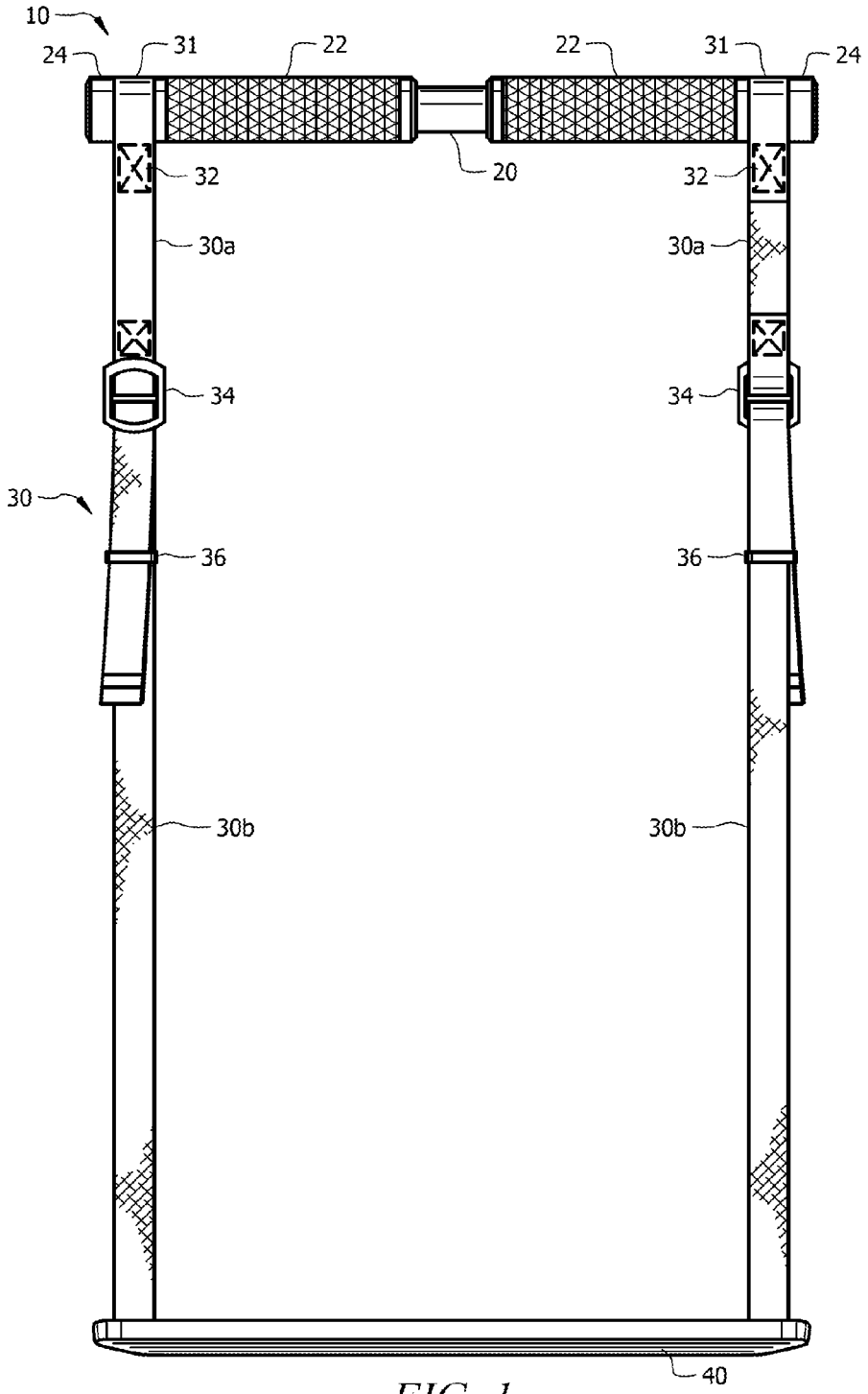
FIG. 1 is a front elevation view of a rear chain stretcher according to an embodiment of the invention.
Figure 6A:
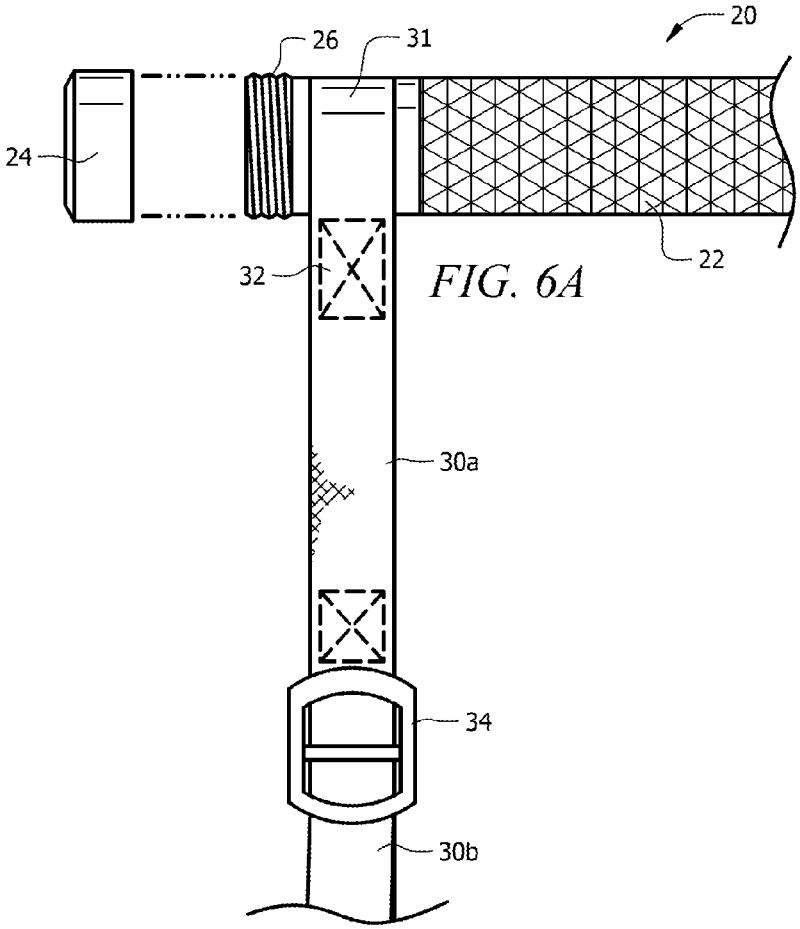
FIG. 6A is a front elevation view of a section of the handle and end cap of the embodiment of the rear chain stretcher shown in FIG. 1.
Figure 6B:
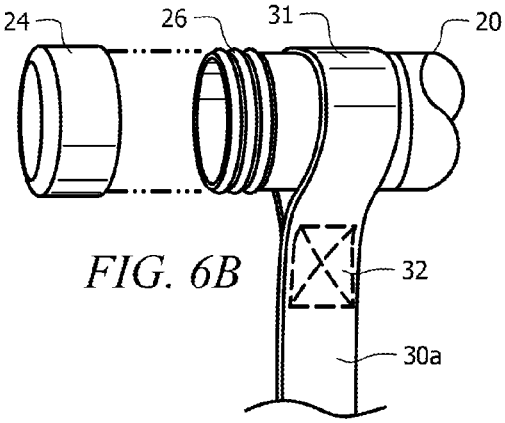
FIG. 6B is a perspective view of a section of the handle and end cap of the embodiment of the rear chain stretcher shown in FIG. 1.

Referring to FIG. 1, the rear chain stretcher 10 has a handle 20, a foot platform 40, or foot panel, and a pair of straps 30 joining the foot panel 40 to the handle 20. The handle 20 is designed to be grasped by the hands of a user. To facilitate grasping the handle 20 by a user, the handle 20 has a pair of grips 22 on the surface of the handle 20. The grips 22 have a surface texture to enhance the ability of the user to grasp the grips without the handle slipping in the user's hands. The handle 20 has a pair of end caps 24 at opposing ends of the handle. The end caps 24 thread onto threads 26 on the handle 20 as shown in FIGS. 6A and 6B. Handle 20 has a hollow interior, which allows the straps 30 to be stored inside the handle 20 when the rear chain stretcher 10 is disassembled. Additionally, a user can store small objects, such as car keys, inside the handle 20 by placing the objects in the interior of the handle and affixing the end caps.

Returning to FIG. 1, the rear chain stretcher 10 has a pair of straps 30 affixed to the handle 20. Strap 30 is composed from a first strap member 30*a* and second strap member 30*b* joined by a slip-lock buckle 34. Slip-lock buckle 34 has an essentially square frame and a pair of bars (not shown) extending between two opposing sides of the frame. The buckle 34 is composed of plastic, although other materials, such as various metals, can be used. Strap member 30*a* has a length of about 26.0 cm, a width of about 1.9 cm, and is securely affixed at one end to slip-lock buckle 34 and at the other end to handle 20. An end of strap member 30*a* is looped over one bar of slip-lock buckle 34 and sewn onto itself to affix the strap 30*a* to the buckle 34 and close the loop. The opposite end of strap 30*a* is looped over a distal end of handle 20 and sewn onto itself to affix the strap 30*a* to handle 20 and close the loop as shown by element 32.

Strap member 30*b* has a total length of about 65.0 cm, a width of about 1.9 cm, and is affixed at one end to the foot platform 40. Strap member 30*b* slidingly engages the buckle 34. The overall length of strap 30 can be adjusted by sliding buckle 34 along the length of strap member 30*b*. By adjusting the positioning of buckle 34 along strap member 30*b*, the overall length of strap 30 can be adjusted from about 30 cm to about 90 cm. Clip 36 surrounds of strap member 30*b* where strap member 30*b* is doubled back to help secure the loose end of strap member 30*b* against the portion of strap member 30*b* where that length extends between foot platform 40 and buckle 34.

In a preferred embodiment strap member 30*a* forms a loop 31 over the exterior surface of the handle 20 and is sewn together, thereby enabling the strap to securely rotate over the surface of the handle. In other words, a junction 32 is formed where a distal end of strap member 30*a* is sewn to the section of strap member 30*s* immediately adjacent to the loop 31. The handle 20 has end caps 24 which removeably affix to the handle 20 and have a diameter slightly larger than that of loop 31 of the strap member 30*a*, thereby preventing loop 31 from sliding off of the end of the handle 20.

Strap 30 can be composed of any flexible, strong, inelastic strap material. Web-type straps made of polypropylene or nylon are preferred as they are strong, abrasion-resistant, inelastic and available in a wide variety of widths, thicknesses and colors. The thickness and width of the strap can be selected to suit the desired strength and flexibility of the rear chain stretcher for a particular user or mode of use. For example, a thinner or narrower strap will provide greater flexibility of the strap at the expense of the tensile strength of the strap. In a preferred embodiment strap 30 is a 1.9 cm to 2.5 cm (i.e. 0.75 to 1-inch) wide polypropylene, web-type strap that is approximately 0.15 cm to 0.18 cm (i.e. 0.060 to 0.070 inch) thick.

Figure 2:
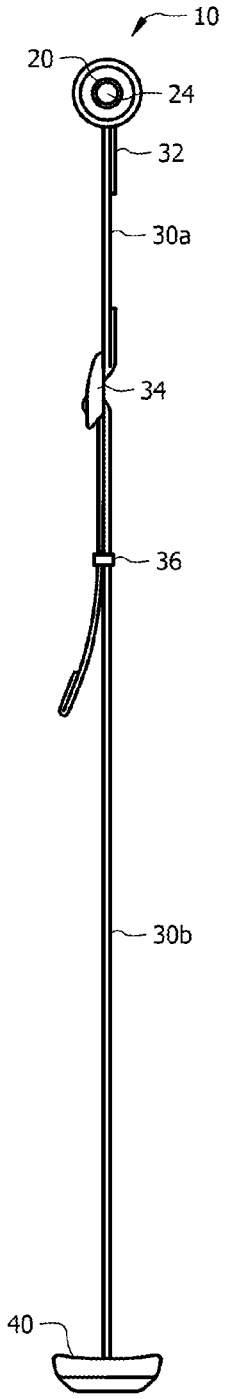
FIG. 2 is a side elevation view of the embodiment of the rear chain stretcher shown in FIG. 1.

FIG. 2 is a side a side elevation view of the embodiment of the rear chain stretcher shown in FIG. 1. The side view shows the handle 20 and foot platform 40 joined by the strap 30. The strap 30 has a first strap member 30*a* and second strap member 30*b* joined by a slip-lock buckle 34. The second strap member 30*b* has a clip 36 to tie down the loose end of the second strap member 30*b*.

Figure 7:
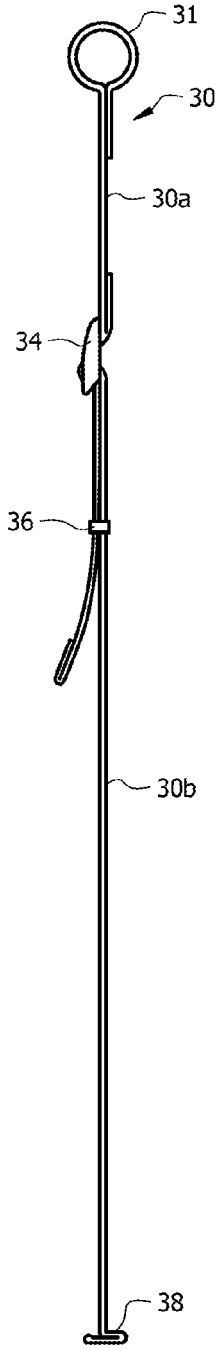
FIG. 7 is a side elevation view of the strap system of the rear chain stretcher shown in FIG. 1.

FIG. 7 is a side elevation view of the strap 30, but lacking the handle 20 and foot platform 40 as shown in FIG. 2. The first strap member 30*a* has a loop 31 at the end of the strap. The loop 31 is designed to slide onto the end of the handle 20 and be locked in place by an end cap 24 (See FIGS. 6A and 6B). Inward movement of the loop 31 on the handle 20 is limited by the grip 22 and outward movement is limited by the end cap 24 when the end cap 24 is in place on the handle 20. The diameter of the loop 31 is just large enough so that it can slide onto the handle 20, but the diameter is smaller that the diameter of the grip 22 or the end cap 24. In addition, the fit of the loop 31 on the handle 20 allows for some rotation of the loop 31 over the handle 20 when the calf stretcher 10 is fully assembled. The end of second strap member 30*b* is doubled-over and sewn onto itself to form strap limit 38. This limits the end of the strap from pulling through the slot 44 of the foot platform 40 (See e.g. FIGS. 4 and 5).

Figure 3:
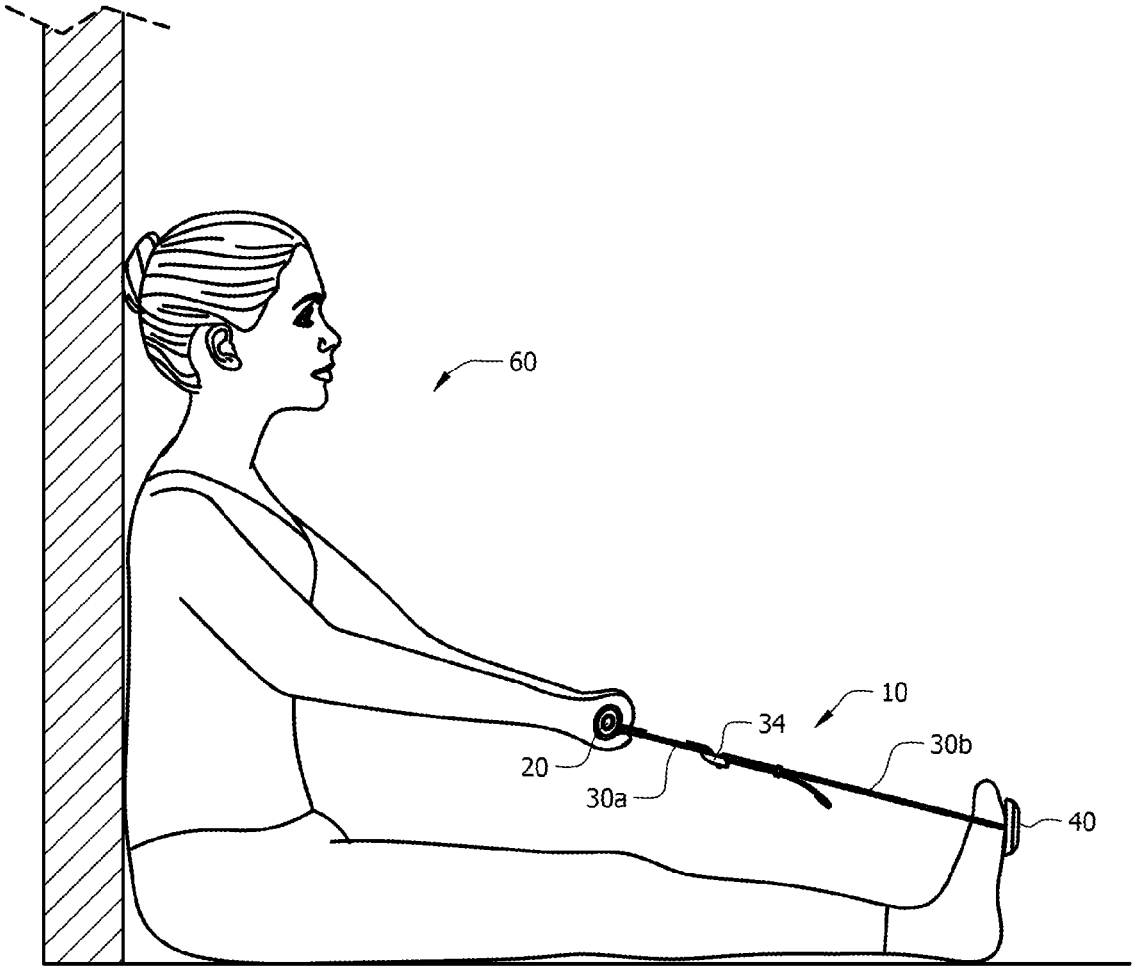
FIG. 3 is a side view of a person using the embodiment of rear chain stretcher shown in FIG. 1.

FIG. 3 is a side view of a user 60 performing a calf muscle stretching exercise using the rear chain stretcher 10 using the first embodiment of the device as shown in FIG. 1. The user 60 will assume a seated position with their legs flat, or straight out, on a floor and their back resting against a wall. The user 60 positions the foot platform 40 on the balls of the user's foot and grasps the grip 22 of the handle 20 with both hands. With the straps 30 taught between the handle 20 and the foot platform 40, the user 60 will gently, but firmly, pull the handle 20 towards the user's abdominal region, while maintaining straight legs. This pulls the foot platform 40 towards the trunk of the user 60, resulting in dorsiflexion of the user's ankle, and resultant stretching of the user's calf muscles when the legs remain straight (i.e. with the user's legs remaining straight by resisting the pull created by the user 60 through the handle 20). The length of the straps 30 can be adjusted to accommodate the user's height and preferences by moving strap 30*b* through buckle 34. So for example, a taller person, or a person preferring to use the rear chain stretcher 10 with their elbows in a more flexed position, can adjust the straps 30*b* to be longer, while a shorter person, or a person preferring to use the rear chain stretcher with their arms extended and with less flex in their elbows, can adjust the straps 30*b* to be shorter.

Figure 4:
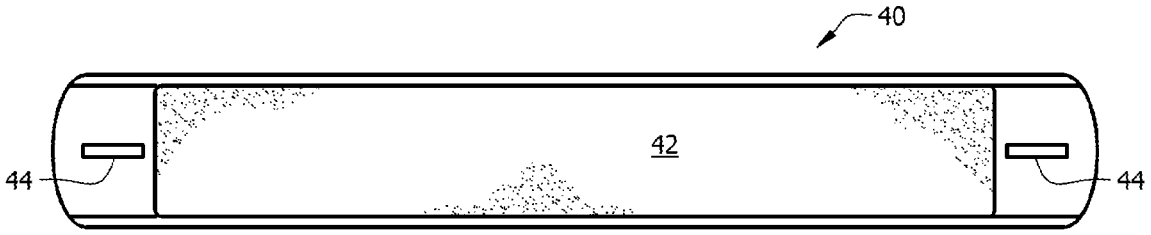
FIG. 4 is a top plan view of the foot platform of the embodiment of the rear chain stretcher shown in FIG. 1.
Figure 5:
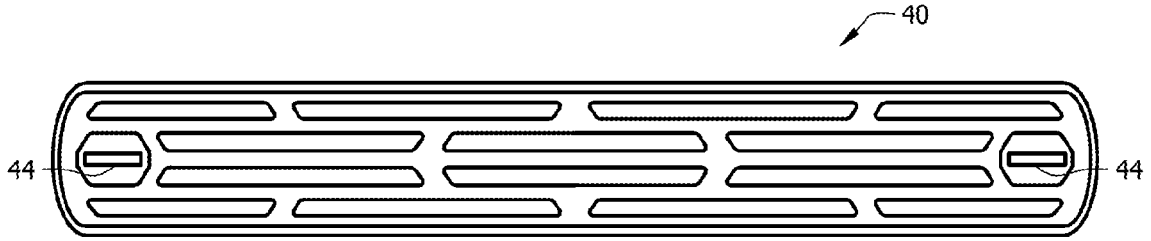
FIG. 5 is a bottom plan view of the foot platform of the embodiment of the rear chain stretcher shown in FIG. 1.

FIGS. 4 and 5 show the top and bottom, respectively, of the foot platform 40. With respect to FIG. 4, the top 42 of the foot platform 40 can have a concave shape to conform to the balls of a user's foot. The foot platform top 42 can also have a cushioned or textured surface to protect a user's foot and prevent slippage. The foot platform 40 has a pair of slots 44 through which the second strap member 30*b* is affixed.

Figure 8:
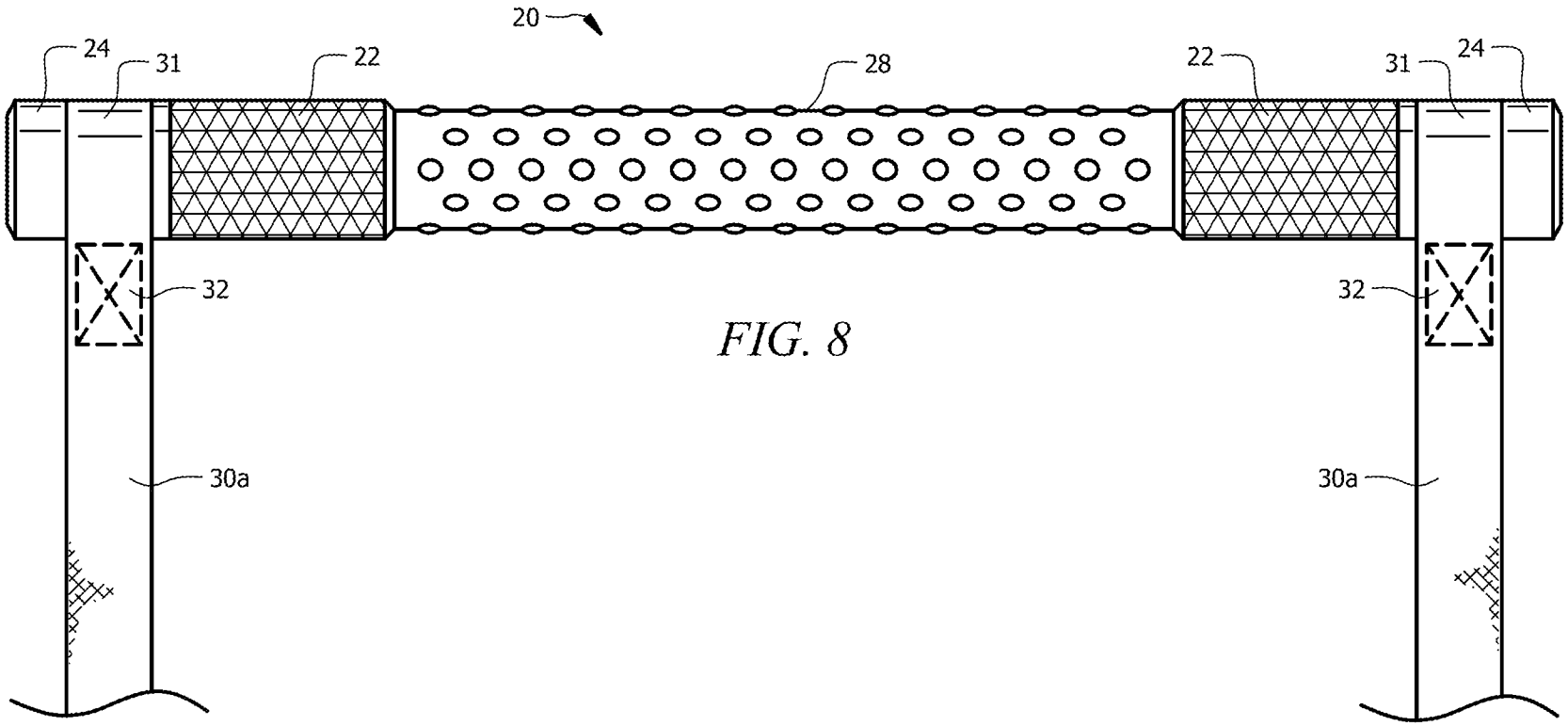
FIG. 8 is a front elevation view of a handle of an alternative embodiment of a rear chain stretcher according to the invention. The embodiment has a massage element between the pair of grips.

FIG. 8 illustrates an alternative embodiment of the handle 20 of the rear chain stretcher 10. The handle 20 has a massaging roller 28 between the two opposing grips 22 of the handle 20. The massaging roller 28 is designed to rotate around the handle 20 when a user presses the roller 28 against their body and moves the handle 20 along the plane of the user's body. In this manner the user is able to massage muscles through the applied pressure of the massage roller 28. The massage roller 28 has a plurality of knobs, or protuberances, on the surface of the roller to enhance the application of pressure.

Glossary of Claim Terms

As used throughout the entire application, the terms "a" and "an" are used in the sense that they mean "at least one", "at least a first", "one or more" or "a plurality" of the referenced components or steps, unless the context clearly dictates otherwise.

The term "and/or" whereever used herein includes the meaning of "and", "or" and "all or any other combination of the elements connected by said term".

The term "about" or "approximately" as used herein means within 20%, preferably within 10%, and more preferably within 5% of a given value or range.

Notwithstanding that the numerical ranges and parameters setting forth the broad scope of the disclosure are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

As used herein, the term "comprising" is intended to mean that the products, compositions and methods include the referenced components or steps, but not excluding others. "Consisting essentially of" when used to define products, compositions and methods, shall mean excluding other components or steps of any essential significance. Thus, a composition consisting essentially of the recited components would not exclude trace contaminants and pharmaceutically acceptable carriers. "Consisting of" shall mean excluding more than trace elements of other components or steps.

All references cited in the present application are incorporated in their entirety herein by reference to the extent not inconsistent herewith.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. An exercise device comprising:

a rod with a pair of grips adapted to be grasped by hands of a user;

a rotatable sleeve with a plurality of surface protuberances, wherein the rotatable sleeve is rotatably coupled to the rod between the pair of grips;

a pair of straps, wherein each strap has a first end and a second end and the first end of each strap forms a loop around an end of the rod and the strap loop is freely rotatable about the rod;

a pair of end caps that removeably engage ends of the rod and secure the loops of the straps to the rod, wherein each end cap is in contact with the loop of a proximate strap; and a foot platform adapted to simultaneously receive balls of a user's feet, wherein the second end of the pair of straps is affixed to distal ends of the foot platform.

2. The exercise device of claim 1 wherein the pair of grips are adapted to be grasped in an anatomically neutral wrist position by the hands of a user.

3. The exercise device of claim 1 wherein the rotatable sleeve with a plurality of surface protuberances is adapted to be used as a muscle or foot massager.

4. The exercise device of claim 1 wherein each strap is composed of two strap members linked by a buckle and the strap length can be adjusted by moving the buckle to a different position on one of the strap members.

5. The exercise device of claim 1 wherein the second end of each strap has a stop at the end of the strap and the foot platform has a pair of slots adapted to receive the strap as the strap is threaded through the slot and wherein displacement of the threaded strap through the slot is limited by the stop.

6. An exercise device comprising:

a hollow rod with a pair of grips adapted to be grasped by hands of a user;

a pair of straps, wherein each strap has a first end and a second end and the first end of each strap forms a loop around an end of the rod and each strap is composed of two strap members linked by a buckle and the strap length can be adjusted by moving the buckle to a different position on one of the strap members;

a pair of end caps that removeably engage ends of the rod and secure each loop to the rod when the end caps are engaged on the rod and allow removal of the loops of each strap from the rod when the end caps are disengaged, wherein each of the loops of the straps is freely rotatable about the rod and in contact with an end cap when the end cap is engaged; and a foot platform adapted to simultaneously receive balls of a user's feet, wherein the second end of each of the straps is affixed to distal ends of the foot platform, wherein the second end of each strap has a stop at the end of the strap and the foot platform has a pair of slots each slot adapted to receive a strap as the strap is threaded through the slot and wherein displacement of the threaded strap through the slot is limited by the stop.

7. The exercise device of claim 6 wherein the hollow rod forms a compartment when the end caps are engaged, thereby allowing storage of articles within the rod by removing and replacing an end cap.

8. The exercise device of claim 6 wherein the strap width is narrower than an inner diameter of the rod, thereby allowing the straps to be stored within the rod when not in use.

9. The exercise device of claim 6 wherein the ends of the rod are threaded and the end caps engage the rod by threading thereon.

10. The exercise device of claim 6 wherein each of the loops of the straps is in contact with one of the pair of grips and the grip prevents medial displacement of the loop along a length of the rod.

* * * * *